US007287475B2

(12) United States Patent
Brunn

(10) Patent No.: US 7,287,475 B2
(45) Date of Patent: Oct. 30, 2007

(54) RELOADABLE NON-LETHAL TRAINING CARTRIDGE

(75) Inventor: Michael Brunn, Sea-Cliff, NY (US)

(73) Assignee: Combined Systems, Inc., Plainview, NY (US)

( * ) Notice: Subject to any disclaimer, the term of this patent is extended or adjusted under 35 U.S.C. 154(b) by 117 days.

(21) Appl. No.: 11/324,566

(22) Filed: Jan. 3, 2006

(65) Prior Publication Data

US 2007/0151473 A1 Jul. 5, 2007

(51) Int. Cl.
*F42B 8/00* (2006.01)

(52) U.S. Cl. ..... 102/444; 102/529

(58) Field of Classification Search ..... 102/439, 102/440, 444, 447, 501, 502, 529
See application file for complete search history.

(56) References Cited

U.S. PATENT DOCUMENTS

| | | | | | |
|---|---|---|---|---|---|
| 1,936,905 | A * | 11/1933 | Gaidos | ..... | 102/447 |
| 3,922,967 | A * | 12/1975 | Mertens | ..... | 102/439 |
| 3,983,817 | A * | 10/1976 | Tucker | ..... | 102/513 |
| 4,164,903 | A * | 8/1979 | Bouza | ..... | 102/444 |
| 4,762,068 | A * | 8/1988 | Lubbers | ..... | 102/439 |
| 5,035,183 | A * | 7/1991 | Luxton | ..... | 102/502 |
| 5,086,703 | A * | 2/1992 | Klein | ..... | 102/439 |
| 5,221,809 | A * | 6/1993 | Cuadros | ..... | 102/439 |
| 5,259,319 | A * | 11/1993 | Dravecky et al. | ..... | 102/447 |
| 5,402,729 | A * | 4/1995 | Richert | ..... | 102/439 |
| 6,041,712 | A * | 3/2000 | Lyon | ..... | 102/439 |
| 6,782,828 | B2 * | 8/2004 | Widener | ..... | 102/502 |
| 6,832,557 | B2 * | 12/2004 | Torsten | ..... | 102/439 |
| 7,021,219 | B1 * | 4/2006 | Dindl | ..... | 102/447 |
| 2003/0136293 | A1 * | 7/2003 | Torsten | ..... | 102/439 |
| 2005/0183613 | A1 * | 8/2005 | Huffman | ..... | 102/444 |
| 2006/0032393 | A1 * | 2/2006 | Haeselich | ..... | 102/502 |

* cited by examiner

*Primary Examiner*—Bret Hayes
(74) *Attorney, Agent, or Firm*—Townsend & Banta

(57) ABSTRACT

A reloadable non-lethal training cartridge is provided comprising a cartridge case, a rear high pressure chamber removably disposed within the base thereof, and a non-lethal payload portion removably disposed adjacent the forward end of the cartridge case. The rear high pressure chamber is provided with a base capable of interacting with a removal tool, such as a hexagonal shaped base capable of interacting with a standard socket. Further, the non-lethal payload portion is comprised of a base and a non-lethal payload, the non-lethal payload and base being removably attached such that one or both of said components may be reused. In addition, the non-lethal payload may be weighted, so as to increase the accuracy thereof.

17 Claims, 7 Drawing Sheets

RELOADABLE NON-LETHAL TRAINING CARTRIDGE

FIELD OF THE INVENTION

The present invention provides a non-lethal reloadable training cartridge for deployment of non-lethal ordnance and reuse of the cartridge case and non-lethal payload. In particular, a low impulse non-lethal reloadable training cartridge is provided, wherein the high pressure chamber containing a blank may be easily and quickly removed from the cartridge case without damage to the cartridge case, allowing for repeated reloading of the cartridge case, and reuse of the cartridge case, non-lethal payload and, optionally, the high pressure chamber.

BACKGROUND OF THE INVENTION

Traditional non-lethal ordnance has consisted of cartridges containing, for example, projectiles consisting of metallic ball bearings coated with a thin layer of plastic or rubber, fabric bags which are filled with lead shot (so-called "bean bags"), and "rubber bullets" formed of hard rubber, foam, plastic or wood. These types of non-lethal ordnance are routinely employed by law enforcement agencies, correctional departments, military organizations, and the like, for instances in which non-lethality is desired.

Non-lethal ordnance, however, performs differently than lethal ordnance, and therefore requires special training. Thus, specialized training is required. As non-lethal ordnance is costly, specialized non-lethal training cartidges are desired.

It is a first object of the present invention to provide a low impulse non-lethal cartridge for use in conventional weapons, such as the 40 mm M203 grenade launcher.

It is a second object of the present invention to provide non-lethal ammunition capable of accelerating a bolt to the rear of the weapons chamber independently of the impulse generated from launching of the non-lethal projectile.

It is a third object of the present invention to provide an ammunition configuration having high/low propellant chambers which allow for consistent propellant burn, and which provide consistent interior ballistics.

SUMMARY OF THE INVENTION

In order to achieve the objects of the invention described above, in a first embodiment of the present invention, a reloadable non-lethal training cartridge is provided comprising:

i. a cartridge case having:

(a) a base comprising an exterior portion, an interior portion, and a base threaded aperture formed within said base from the exterior portion;

(b) a circumferential portion adjacent said base defining an exterior portion and an interior, said interior portion defining a low pressure chamber; and (b) a forward end adjacent said circumferential portion, ii. a rear high pressure chamber removably disposed within the base threaded aperture of the cartridge case, said rear high pressure chamber having:

(c) a base comprising an outer circumference capable of engagement with a removal tool, an inner portion, and a firing blank insertion aperture formed through said inner portion;

(d) a circumferential portion adjacent said base, said circumferential portion comprising an exterior portion having threads formed thereon, and an interior portion defining an interior firing blank containment portion; and (e) a forward end adjacent said circumferential portion, said forward end having a propellant vent hole formed therethrough, said propellant vent hole having an outer circumference, iii. a non-lethal payload portion removably attached to the forward end of said cartridge case, said non-lethal payload portion having:

(f) a base comprising a rear face, a rear edge adjacent the rear face having a frictional engagement means capable of frictional engagement with the forward end of said cartridge case, and a circumferential portion adjacent the rear edge having a non-lethal payload engagement portion; and (g) a non-lethal payload disposed adjacent the non-lethal payload engagement means of said base, wherein the high pressure chamber may be threadably removed from the cartridge case after firing of the reloadable non-lethal training cartridge.

In a second embodiment of the present invention, the reloadable non-lethal training cartridge of the first embodiment above is provided, wherein the high pressure chamber further comprises an o-ring disposed around the circumferential portion and adjacent the base, so as to contact the cartridge case base threaded aperture and the high pressure chamber base and thereby create a seal.

In a third embodiment of the present invention, the reloadable non-lethal training cartridge of the first embodiment above is provided, wherein the high pressure chamber further comprises:

a washer removably disposed within the interior portion of the circumferential portion of the rear high pressure chamber, adjacent the propellant vent hole, said washer having a aperture disposed therethrough, said aperture having a diameter smaller than a diameter of the propellant vent hole formed in the forward end of the high pressure chamber.

In a fourth embodiment of the present invention, the reloadable non-lethal training cartridge of the first embodiment above is provided, wherein the cartridge case is comprised of a plastic or polymeric material.

In a fifth embodiment of the present invention, the reloadable non-lethal training cartridge of the first embodiment above is provided, wherein the cartridge case is comprised of a metallic material.

In a sixth embodiment of the present invention, the reloadable non-lethal training cartridge of the first embodiment above is provided, wherein the non-lethal payload engagement means and the non-lethal payload of the non-lethal payload portion are removably engaged.

In a seventh embodiment of the present invention, the reloadable non-lethal training cartridge of the first embodiment above is provided, wherein the non-lethal payload engagement means and the non-lethal payload of the non-lethal payload portion are fixedly engaged.

In a eighth embodiment of the present invention, the reloadable non-lethal training cartridge of the sixth embodiment above is provided, wherein the non-lethal payload engagement means is comprised of a threaded portion, an interlocking means, or a frictional engagement means.

In a ninth embodiment of the present invention, the reloadable non-lethal training cartridge of the eighth embodiment above is provided, wherein the non-lethal payload comprises an engagement portion and a payload portion, said engagement portion capable of removable engagement with the non-lethal payload engagement means of the non-lethal payload portion.

In a tenth embodiment of the present invention, the reloadable non-lethal training cartridge of the ninth embodiment above is provided, wherein the non-lethal payload portion is comprised of a hollow or solid foam head, a hollow or solid rubber head, a hollow or solid plastic head, or a hollow or solid head comprised of a combination of foam, rubber or plastic.

In an eleventh embodiment of the present invention, the reloadable non-lethal training cartridge of the tenth embodiment above is provided, wherein the non-lethal payload portion further comprises weighted material disposed within the hollow head.

In a twelfth embodiment of the present invention, the reloadable non-lethal training cartridge of the first embodiment above is provided, wherein the threads formed on the circumferential portion of the high pressure chamber are double threads.

In a thirteenth embodiment of the present invention, the reloadable non-lethal training cartridge of the first embodiment above is provided, wherein the threads formed on the circumferential portion of the high pressure chamber are single threads.

In a fourteenth embodiment of the present invention, the reloadable non-lethal training cartridge of the first embodiment above is provided, wherein the circumference of the base of the rear high pressure chamber is square, pentagonal, hexagonal or octagonal in shape.

In a fifteenth embodiment of the present invention, a reloadable cartridge is provided comprising:

i. a cartridge case having:

(a) a base comprising an exterior portion, an interior portion, and a base threaded aperture formed within said base from the exterior portion;

(b) a circumferential portion adjacent said base defining an exterior portion and an interior, said interior portion defining a low pressure chamber; and (b) a forward end adjacent said circumferential portion, ii. a rear high pressure chamber having:

(c) a base comprising an outer circumference having a non-circular shape so as to allow engagement with a removal tool, an inner portion, and a firing blank insertion aperture formed through said inner portion;

(d) a circumferential portion adjacent said base, said circumferential portion comprising an exterior portion having threads formed thereon, and an interior portion defining an interior blank containment portion; and (e) a forward end adjacent said circumferential portion, said forward end having a propellant vent hole formed therethrough, iii. a payload portion removably disposed adjacent the forward end of said cartridge case, said payload portion having:

(f) a base comprising a rear face, a rear edge adjacent the rear face having a frictional engagement means capable of frictional engagement with the forward end of said cartridge case, and a circumferential portion adjacent the rear edge having a payload engagement portion; and (g) a payload disposed adjacent the non-lethal payload engagement means of said base, wherein the high pressure chamber may be threadably removed from the cartridge case after firing of the reloadable non-lethal training cartridge, and the payload portion may be removed and replaced after firing.

In a sixteenth embodiment of the present invention, the reloadable non-lethal training cartridge of the first embodiment above is provided, wherein the non-lethal payload portion further comprises a rotating band disposed around the circumferential portion of the base, the rotating band capable of interacting with a barrel rifling groove.

In a seventeenth embodiment of the present invention, the reloadable cartridge of the fifteenth embodiment above is provided, wherein the payload portion further comprises a rotating band disposed around the circumferential portion of the base, said rotating band capable of interacting with a barrel rifling groove.

DETAILED DESCRIPTION OF THE INVENTION

Figure 1:
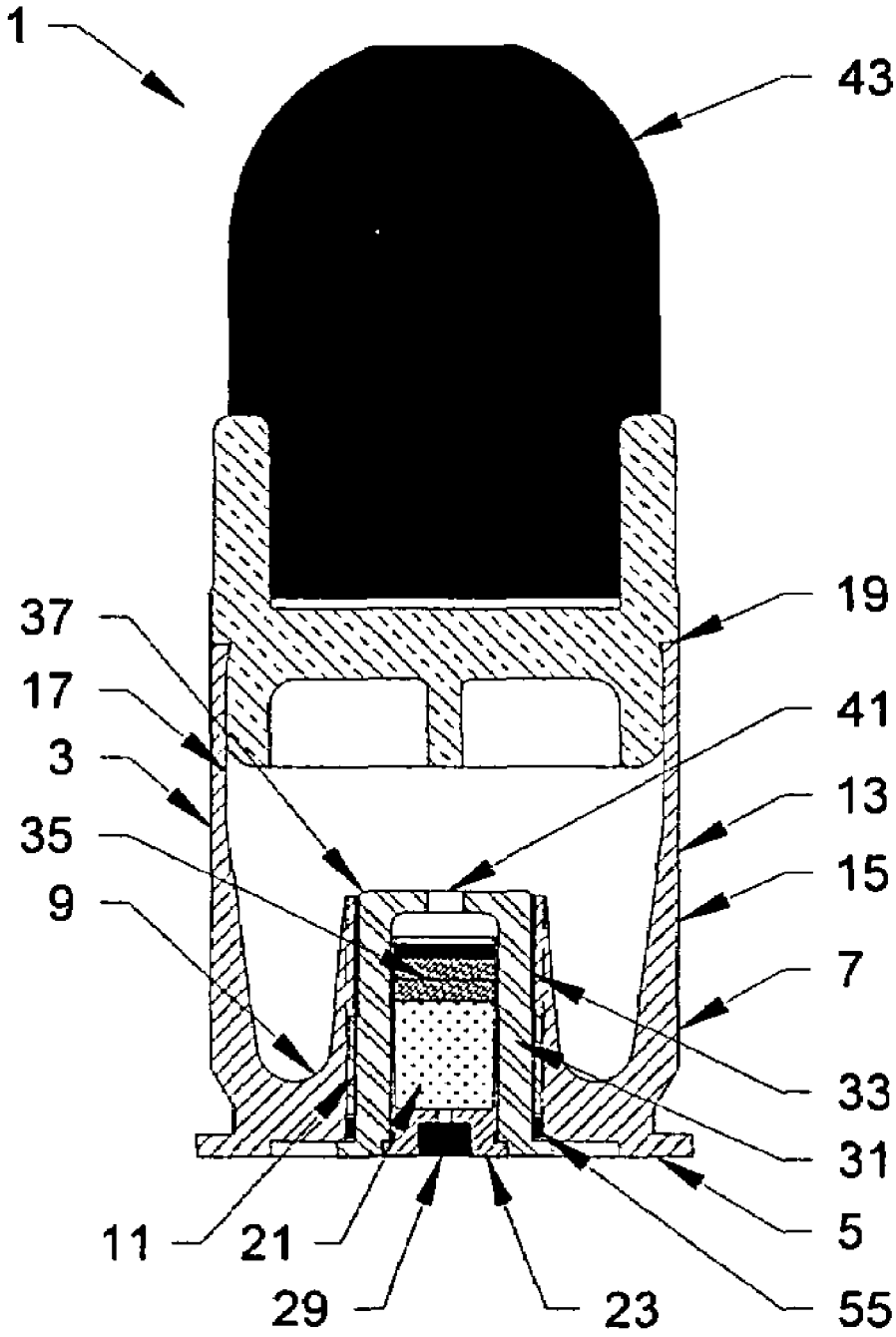
FIG. 1 is a cross sectional view of the reloadable non-lethal training cartridge of the first and second embodiments of the present invention.

As illustrated in FIG. 1, the reloadable non-lethal training cartridge 1 of the present invention is comprised of a cartridge case 3, a rear high pressure chamber 21 removably disposed within the cartridge case 3, and a non-lethal payload portion 43 removably disposed adjacent the cartridge case 3, opposite the rear high pressure chamber 21. The cartridge case 3 may consist of a plastic material, polymeric material, or a metallic material.

The cartridge case 3 is comprised of a base 5, the base 5 having an exterior portion 7, an interior portion 9, a threaded aperture 11 disposed through said base 5 from the exterior portion 7 to the interior portion 9, a circumferential portion 13 adjacent the base 5, and a forward end 19 adjacent the circumferential portion 13. The circumferential portion 13 has an exterior 15 and an interior 17.

As mentioned above, and as illustrated in FIGS. 1-4, a rear high pressure chamber 21 is removably disposed within the base threaded aperture 11, and can be removed and replaced after firing of the reloadable non-lethal training cartridge 1. The rear high pressure chamber is comprised of a base 23 having an outer circumference 25, a circumferential portion 31 adjacent the base 23, the circumferential portion 31 having an exterior portion 33 and an interior portion 35, and a forward end 37 adjacent the circumferential portion 31. Further, an inner portion 27 of the rear high pressure chamber 21 is defined by the base 23, circumferential portion 31 and forward end 37.

Figure 6:
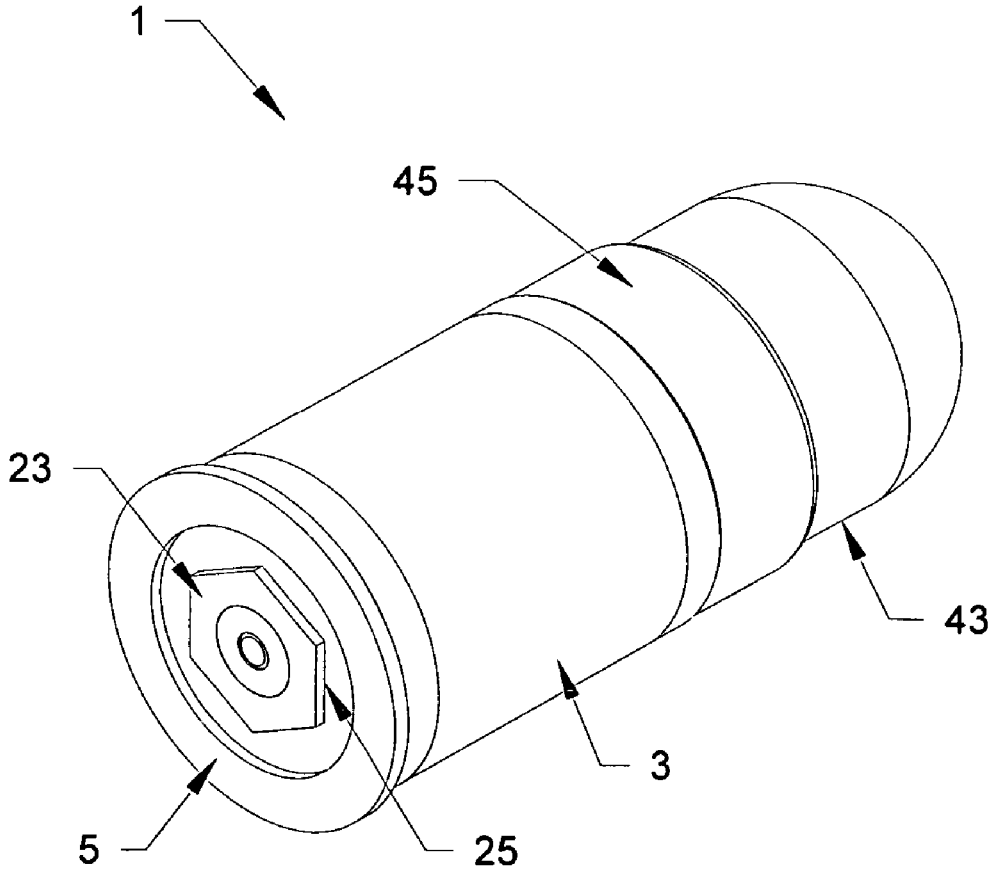
FIG. 6 is a perspective view of the reloadable non-lethal training cartridge of the first and fifteenth embodiments of the present invention, illustrating the hexagonal base embodiment of the rear high pressure chamber.
Figure 7:
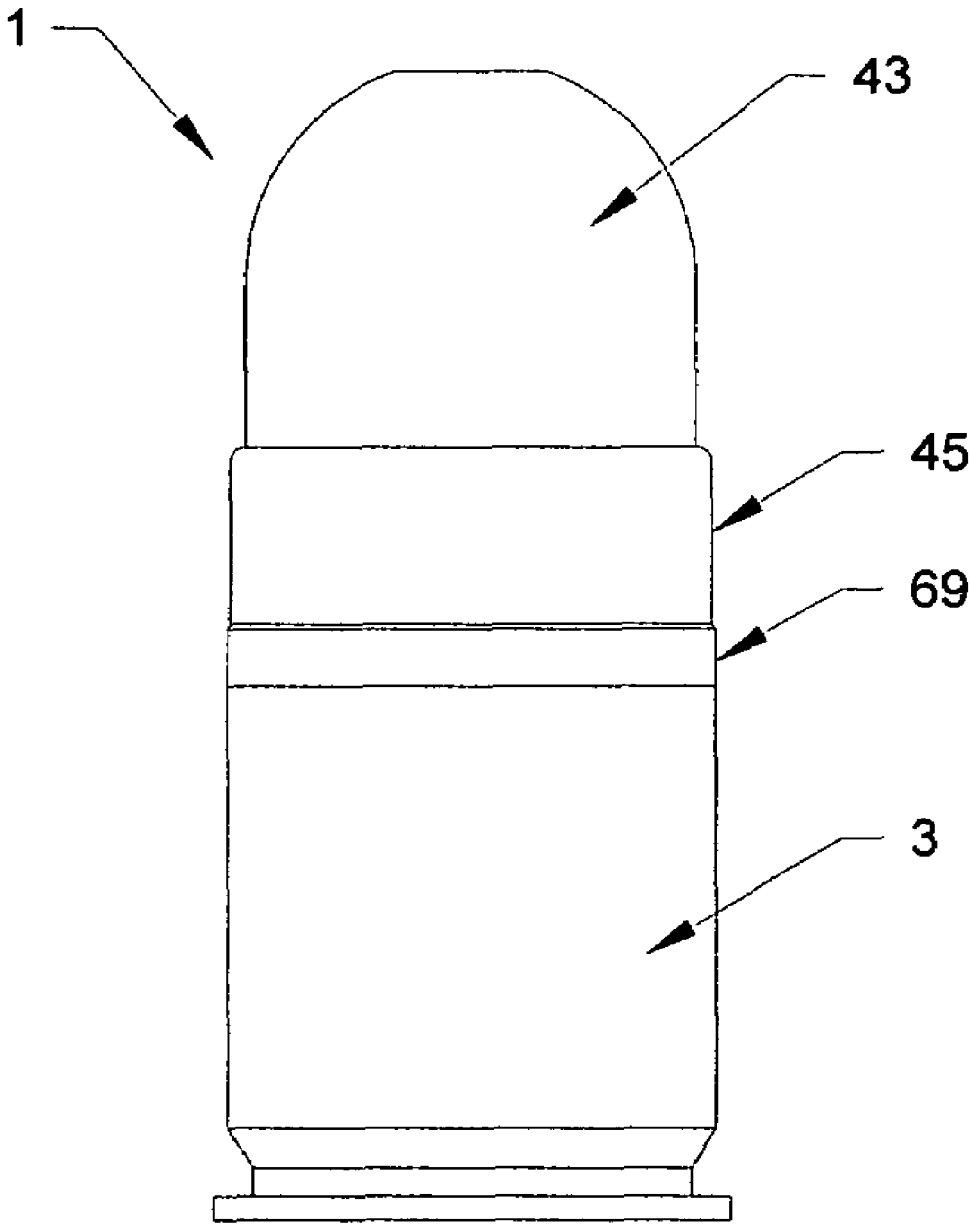
FIG. 7 is a side view of the reloadable non-lethal training cartridge of the seventeenth embodiments of the present invention, illustrating the rotating band disposed around the circumferential portion of the base of the payload portion.

As called for in the first and fifteenth embodiments of the present invention, the base 23 of the rear high pressure chamber 21 has an outer circumference 25 of the base 23 of the rear high pressure chamber 21 is capable of engagement with a removal tool. Conventionally, if a user desired to reuse a non-lethal training cartridge, removal of the rear high pressure chamber was very difficult, and required sending the training cartridges back to the armory for reconditioning. However, with the present invention, as illustrated in FIG. 6 herein, the outer circumference 25 may have a hexagonal shape, such that a user in the field can remove and replace the rear high pressure chamber 21 using a standard socket wrench. Alternatively, the outer circumference may be grooved, octagonal shaped, etc., to enable interaction with a tool of choice.

Figure 3:
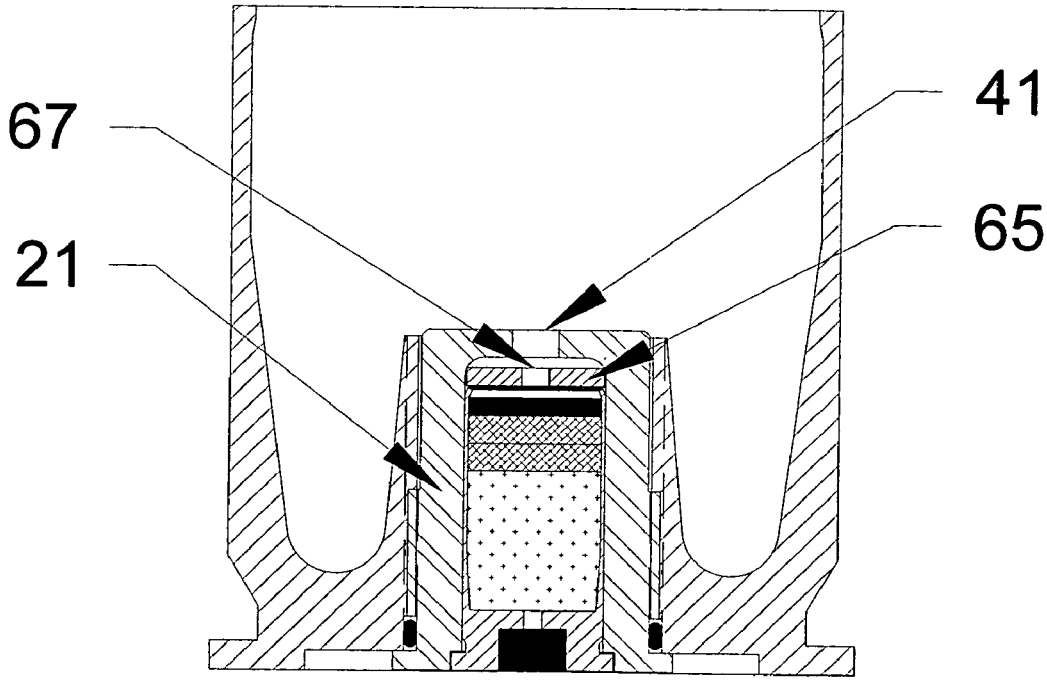
FIG. 3 is a partial cross sectional view of the reloadable non-lethal training cartridge of the present invention, illustrating the third embodiment herein.

In a further embodiment of the rear high pressure chamber, as called for in the third embodiment herein, and as illustrated in FIG. 3, a washer 65 is removably disposed within the interior portion 35 of the circumferential portion 31 of the rear high pressure chamber 21, adjacent the forward end 37 thereof. The washer 65 has an aperture 67 smaller than the outer circumference 41 of the propellant vent hole, so as to restrict the release of high pressure propellant gases into the interior portion of the cartridge 3. The diameter of the aperture 65 may be adjusted (chosen prior to use) to alter the firing characteristics of the non-lethal payload portion 43. In particular, by decreasing the diameter of the aperture 65, the firing of the non-lethal payload portion 43 may be delayed.

A firing blank insertion aperture 29 is disposed through said base 23, within the outer circumference 25, so as to allow for the insertion of firing blanks into the rear high pressure chamber. The firing blank insertion aperture may, optionally, be threaded or provided with friction engagement means, so as to allow for the reloading of firing blanks therein without excessive damage to the aperture 29, and the reuse of the rear high pressure chamber 21.

A propellant vent hole 39 having an outer circumference 41 is disposed through the forward end 37 of the rear high pressure. When the reloadable non-lethal training cartridge 1 is fired by a user, the blank is fired, generating high pressure propellant gases within the rear high pressure chamber 21. These propellant gases are allowed to controllably vent through the propellant vent hole 39, thus increasing pressure within the interior portion 9 (acting as the low pressure chamber) of the cartridge 1. This increasing pressure disengages and propels the non-lethal payload portion 43 from the cartridge case 3, and down the barrel of the weapon.

In a preferred embodiment, as called for in the second embodiment of the present invention, and as illustrated in FIG. 1, the rear high pressure chamber 21 further comprises an o-ring 55, which is disposed around the circumferential portion 31 adjacent the base 23 of the rear high pressure chamber 21. This o-ring acts to seal the interior portion of the cartridge case 3, which acts as a low pressure chamber, by providing a tight seal between the cartridge case 3 and the rear high pressure chamber 21. Thus, accurate velocity of the non-lethal payload portion 43 is ensured.

As illustrated in FIGS. 1-4, the non-lethal payload portion 43 is removably attached to the forward end 19 of the cartridge case 3 via frictional engagement means. The non-lethal payload portion 43 is comprised of a non-lethal payload portion base 45 having a rear face 47 and a rear edge 49 adjacent the rear face 47, a circumferential portion 51 adjacent the rear edge 49, and a non-lethal payload 53 removably or fixedly attached to the base 45.

Figure 2:
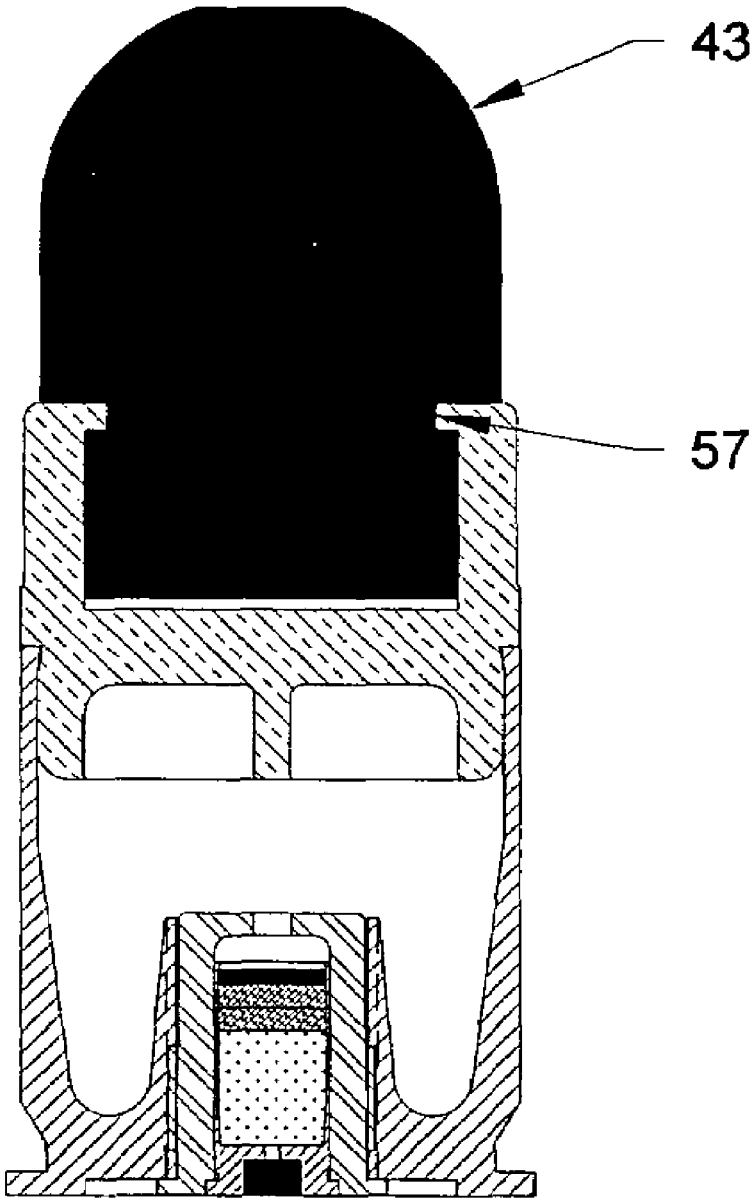
FIG. 2 is a cross sectional view of the reloadable non-lethal training cartridge of the present invention, illustrating an example of the sixth embodiment herein.
Figure 4:
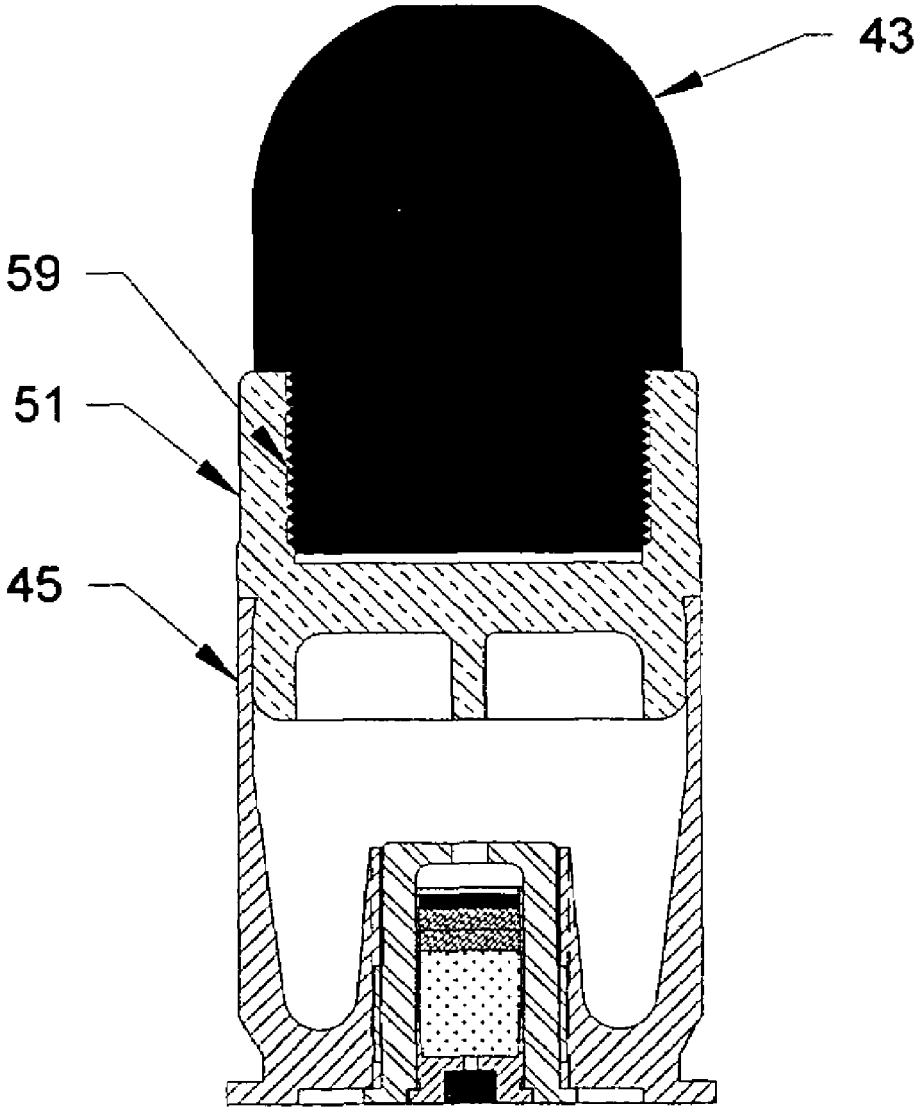
FIG. 4 is a cross sectional view of the reloadable non-lethal training cartridge of the present invention, illustrating the solid head embodiment being threadedly engaged to the base of the non-lethal payload portion of the eighth through tenth embodiments herein.

For example, frictional engagement means 57, as called for in the sixth embodiment herein, and as illustrated in FIG. 2, consisting of a ridge formed on the circumferential portion 51 and/or the non-lethal payload 53, may be utilized to removably attach the base 45 to the non-lethal payload 53, so that the base 45 and/or the non-lethal payload 53. Alternatively, as shown in FIG. 4, threads 59 may be provided on the circumferential portion 51 of the base 45, so as to engage threads formed on the non-lethal payload 43.

Alternatively, the base 45 may be fixedly attached to the non-lethal payload 43, by adhering the non-lethal payload to the base 45 with an adhesive. When fixedly attached, the longevity of the non-lethal payload portion is dependent upon the condition of both the base 45 and the non-lethal payload 53. In contrast, when the base 45 is removably attached to the non-lethal payload 53, if one component is damaged during use, only that component need be replaced, and the remaining component in good condition may be reused.

The non-lethal payload 53 may be comprised of a hollow or solid foam head, a hollow or solid rubber head, a hollow or solid plastic head, or a hollow or solid head comprised of a combing of foam, rubber and/or plastic. Importantly, the non-lethal payload material must consist of a material that is not severely injurious to a person when being struck at a fairly high velocity, such as from 280-350 fps (feet per second).

Figure 5:
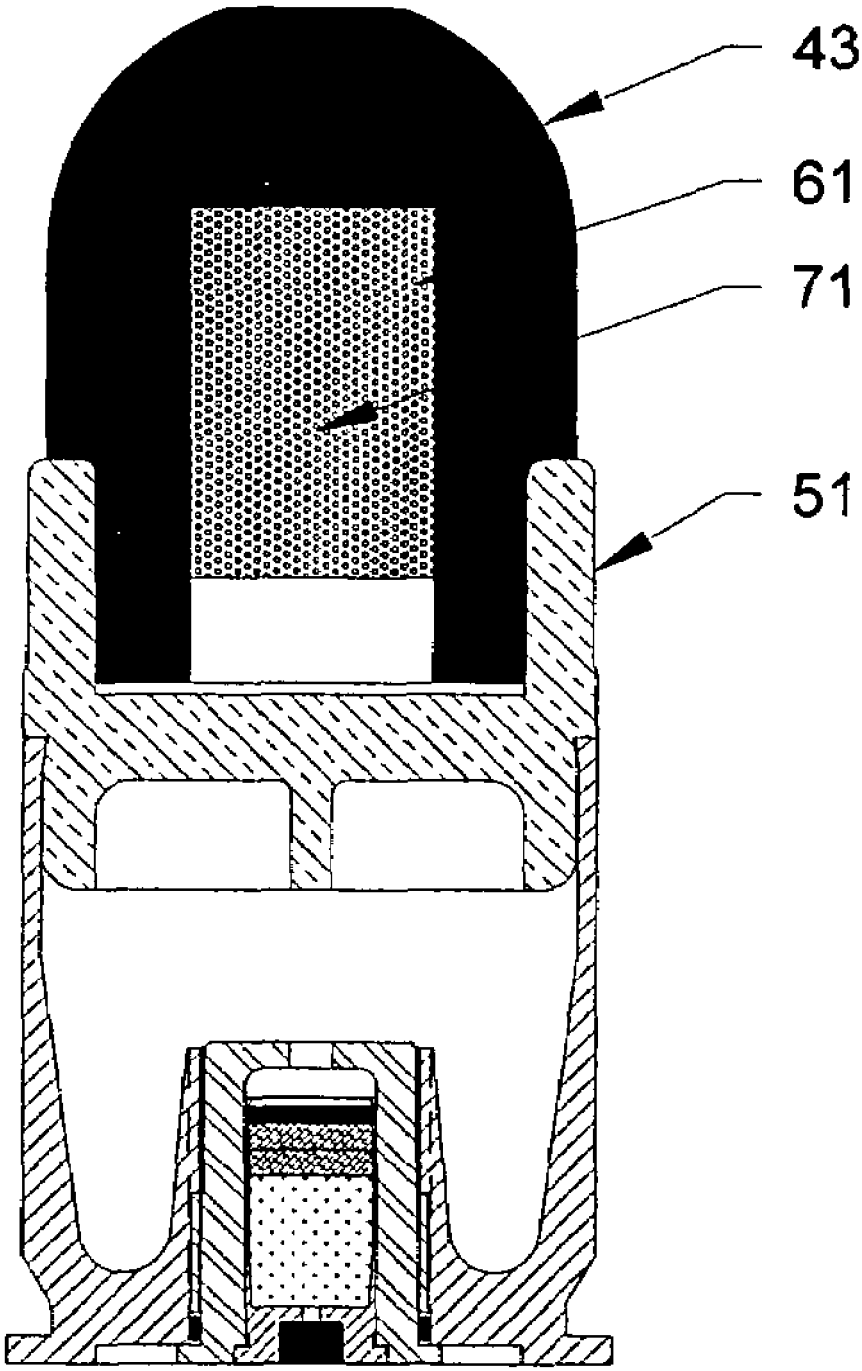
FIG. 5 is a partial cross sectional view of the reloadable non-lethal training cartridge of the present invention, illustrating the tenth and eleventh embodiments of the present invention, wherein the non-lethal payload portion is comprised of a hollow head filled with lead pellets.

In a further embodiment of the non-lethal payload portion, as called for in the eleventh embodiment herein, and as illustrated in FIG. 5, the hollow portion 61 of the non-lethal payload 43 may be filled with a weighted material 71, such as lead pellets, shot, etc. In FIG. 5, the weighted material 71 is lead shot. It was unexpectedly discovered by the present inventor that by weighting the non-lethal payload 43 with the weighted material 71, accuracy was dramatically increased at extended ranges of, for example, about 50 meters.

As called for in the sixteenth and seventeenth embodiments of the present invention, and as illustrated in FIG. 8 herein, a rotating band 69 is provided, which is disposed around the circumferential portion 51 of the base 45 of the non-lethal payload portion 43. This rotating band 69 interacts with the barrel rifling groove of the weapon used to fire the cartridge 1, so as to impart a spin to the non-lethal payload portion 43 when fired. The spinning of the non-lethal payload portion 43 spin stabilizes same, thus increasing the accuracy thereof.

FIGURE ELEMENT NUMBERING LIST

1 reloadable non-lethal training cartridge
3 cartridge case
5 base of cartridge case
7 exterior portion of base of cartridge case
9 interior portion of base of cartridge case
11 base threaded aperture
13 circumferential portion of cartridge case
15 exterior portion of circumferential portion
17 interior portion of circumferential portion
19 forward end of cartridge case
21 rear high pressure chamber

23 rear high pressure chamber base
25 outer circumference of rear high pressure chamber base
27 inner portion of rear high pressure chamber base
29 firing blank insertion aperture of rear high pressure chamber base
31 circumferential portion of rear high pressure chamber
33 exterior portion of circumferential portion of rear high pressure chamber
35 interior portion of circumferential portion of rear high pressure chamber
37 forward end of rear high pressure chamber
39 propellant vent hole of rear high pressure chamber
41 outer circumference of propellant vent hole
43 non-lethal payload portion
45 non-lethal payload portion base
47 rear face of base of non-lethal payload portion
49 rear edge of base of non-lethal payload portion
51 circumferential portion of base of non-lethal payload portion
55 o-ring of high pressure chamber
57 frictional non-lethal payload engagement means of the non-lethal payload of the fifth embodiment, as shown in FIG. 2.
59 threads of non-lethal payload engagement means, disposed on the interior portion of circumferential portion of the base of the non-lethal payload , as called for in the seventh embodiment and as shown in FIG. 4.
61 hollow portion of nonlethal payload, as called for in the ninth embodiment.
63 weighted material (lead pellets) disposed in hollow portion 61, as called for in the tenth embodiment.
65 washer, which is removably disposed within the interior portion 35 of circumferential portion of the rear high pressure chamber, as called for in the eleventh embodiment.
67 aperture of washer 65
69 rotating band, which is disposed around the circumferential portion of the base 45 of the non-lethal payload portion 43
71 weighted material, as shown in FIG. 5 in the hollow portion 61 of the non-lethal payload 53

What is claimed is:

1. A reloadable non-lethal training cartridge comprising:

i. a cartridge case having:

(a) a base comprising an exterior portion, an interior portion, and a base threaded aperture formed within said base from the exterior portion;

(b) a circumferential portion adjacent said base defining an exterior portion and an interior portion, said interior portion defining a low pressure chamber; and (b) a forward end adjacent said circumferential portion, ii. a rear high pressure chamber removably disposed within the base threaded aperture of the cartridge case, said rear high pressure chamber having:

(c) a base comprising an outer circumference capable of engagement with a removal tool, an inner portion, and a firing blank insertion aperture formed through said inner portion;

(d) a circumferential portion adjacent said base, said circumferential portion comprising an exterior portion having threads formed thereon, and an interior portion defining an interior firing blank containment portion; and (e) a forward end adjacent said circumferential portion, said forward end having a propellant vent hole formed therethrough, said propellant vent hole having an outer circumference, iii. a non-lethal payload portion removably disposed adjacent the forward end of said cartridge case, said non-lethal payload portion having:

(f) a base comprising a rear face, a rear edge adjacent the rear face having a frictional engagement means capable of frictional engagement with the forward end of said cartridge case, and a circumferential portion adjacent the rear edge having a non-lethal payload engagement portion; and (g) a non-lethal payload disposed adjacent the non-lethal payload engagement means of said base, wherein the high pressure chamber may be threadably removed from the cartridge case after firing of the reloadable non-lethal training cartridge.

2. The reloadable non-lethal training cartridge of claim 1, wherein the high pressure chamber further comprises an o-ring disposed around the circumferential portion and adjacent the base, so as to contact the cartridge case base threaded aperture and the high pressure chamber base and thereby create a seal.

3. The reloadable non-lethal training cartridge of claim 1, wherein the cartridge case is comprised of a plastic or polymeric material.

4. The reloadable non-lethal training cartridge of claim 1, wherein the cartridge case is comprised of a metallic material.

5. The reloadable non-lethal training cartridge of claim 1, wherein the non-lethal payload engagement means and the non-lethal payload of the non-lethal payload portion are removably engaged.

6. The reloadable non-lethal training cartridge of claim 1, wherein the non-lethal payload engagement means and the non-lethal payload of the non-lethal payload portion are fixedly engaged.

7. The reloadable non-lethal training cartridge of claim 5, wherein the non-lethal payload engagement means is comprised of a threaded portion, an interlocking means, or a frictional engagement means.

8. The reloadable non-lethal training cartridge of claim 7, wherein the non-lethal payload comprises an engagement portion and a payload portion, said engagement portion capable of removable engagement with the non-lethal payload engagement means of the non-lethal payload portion.

9. The reloadable non-lethal training cartridge of claim 8, wherein the non-lethal payload portion is comprised of a hollow or solid foam head, a hollow or solid rubber head, a hollow or solid plastic head, or a hollow or solid head comprised of a combination of foam, rubber or plastic.

10. The reloadable non-lethal training cartridge of claim 8, wherein the non-lethal payload portion further comprises weighted material disposed within the hollow head.

11. The reloadable non-lethal training cartridge of claim 1, wherein the high pressure chamber further comprises a washer removably disposed within the interior portion adjacent the forward end of the high pressure chamber, said washer having an aperture formed therethrough, said aperture having a diameter smaller than a diameter of the propellant vent hole formed in the forward end of the high pressure chamber.

12. The reloadable non-lethal training cartridge of claim 1, wherein the threads formed on the circumferential portion of the high pressure chamber are double threads.

13. The reloadable non-lethal training cartridge of claim 1, wherein the threads formed on the circumferential portion of the high pressure chamber are single threads.

14. The reloadable non-lethal training cartridge of claim 1, wherein the circumference of the base of the rear high pressure chamber is square, pentagonal, hexagonal or octagonal in shape.

15. A reloadable cartridge comprising:

i. a cartridge case having:

(a) a base comprising an exterior portion, an interior portion, and a base threaded aperture formed within said base from the exterior portion;

(b) a circumferential portion adjacent said base defining an exterior portion and an interior portion, said interior portion defining a low pressure chamber; and (b) a forward end adjacent said circumferential portion, ii. a rear high pressure chamber having:

(c) a base comprising an outer circumference having a non-circular shape so as to allow engagement with a removal tool, an inner portion, and a firing blank insertion aperture formed through said inner portion;

(d) a circumferential portion adjacent said base, said circumferential portion comprising an exterior portion having threads formed thereon, and an interior portion defining an interior blank containment portion; and (e) a forward end adjacent said circumferential portion, said forward end having a propellant vent hole formed therethrough, iii. a payload portion removably disposed adjacent the forward end of said cartridge case, said payload portion having:

(f) a base comprising a rear face, a rear edge adjacent the rear face having a frictional engagement means capable of frictional engagement with the forward end of said cartridge case, and a circumferential portion adjacent the rear edge having a payload engagement portion; and (g) a payload disposed adjacent the non-lethal payload engagement means of said base, wherein the high pressure chamber may be threadably removed from the cartridge case after firing of the reloadable non-lethal training cartridge, and the payload portion may be removed and replaced after firing.

16. The reloadable non-lethal training cartridge of claim 1, wherein the non-lethal payload portion further comprises a rotating band disposed around the circumferential portion of the base, said rotating band capable of interacting with a barrel rifling groove.

17. The reloadable non-lethal training cartridge of claim 1, wherein the non-lethal payload portion further comprises a rotating band disposed around the circumferential portion of the base, said rotating band capable of interacting with a barrel rifling groove.

* * * * *